US008651590B2

(12) United States Patent
Wilson et al.

(10) Patent No.: US 8,651,590 B2
(45) Date of Patent: Feb. 18, 2014

(54) LEVELING ASSEMBLY FOR APPLIANCE DOORS

(75) Inventors: Mark Wayne Wilson, Simpsonville, KY (US); Cory J. Tafoya, Louisville, KY (US); Matthew Keith Sease, Charlestown, IN (US)

(73) Assignee: General Electric Company, Schenectady, NY (US)

( * ) Notice: Subject to any disclaimer, the term of this patent is extended or adjusted under 35 U.S.C. 154(b) by 3 days.

(21) Appl. No.: 13/104,349

(22) Filed: May 10, 2011

(65) Prior Publication Data

US 2012/0286632 A1 Nov. 15, 2012

(51) Int. Cl.
*A47B 17/04* (2006.01)
*A47B 97/00* (2006.01)

(52) U.S. Cl.
USPC ..... 312/204

(58) Field of Classification Search
USPC ..... 312/204, 405, 265.5, 265.6; 16/105, 32, 16/33
See application file for complete search history.

(56) References Cited

U.S. PATENT DOCUMENTS

| | | | | | |
|---|---|---|---|---|---|
| 689,569 | A * | 12/1901 | Ahlvin | 16/96 R |
| 1,042,927 | A * | 10/1912 | King | 16/105 |
| 2,147,909 | A * | 2/1939 | Mafera | 254/104 |
| 3,171,632 | A * | 3/1965 | Jines | 254/104 |
| 3,528,691 | A * | 9/1970 | Matich, Jr. | 403/356 |
| 5,090,924 | A * | 2/1992 | Pfaller et al. | 439/807 |
| 5,970,660 | A * | 10/1999 | Jacobs | 49/425 |
| 6,889,946 | B2 * | 5/2005 | Bizaj | 248/188.2 |
| 7,328,879 | B1 * | 2/2008 | Plangetis | 248/679 |
| 8,388,074 | B1 * | 3/2013 | Donberger et al. | 312/204 |
| 2004/0222725 | A1 * | 11/2004 | Park et al. | 312/405 |
| 2009/0039750 | A1 * | 2/2009 | Laible et al. | 312/405 |
| 2009/0045705 | A1 | 2/2009 | Laible et al. | |
| 2009/0155557 | A1 | 6/2009 | DeVos et al. | |
| 2009/0302723 | A1 * | 12/2009 | Laible et al. | 312/237 |

FOREIGN PATENT DOCUMENTS

| | | | | |
|---|---|---|---|---|
| DE | 3218837 | A1 * | 11/1983 | E05D 7/04 |
| EP | 108677 | A1 * | 5/1984 | E06B 3/70 |
| EP | 647821 | A1 * | 4/1995 | F25D 23/02 |
| EP | 877215 | A2 * | 11/1998 | F25D 23/10 |
| FR | 2802787 | A3 * | 6/2001 | A47B 96/20 |
| GB | 2050814 | A * | 1/1981 | A47B 77/08 |
| KR | 1020040082097 | A * | 9/2004 | F25D 23/10 |
| WO | WO 2009127549 | A1 * | 10/2009 | A47B 77/08 |

* cited by examiner

*Primary Examiner* — Janet M Wilkens
*Assistant Examiner* — Andrew Roersma
(74) *Attorney, Agent, or Firm* — Dority & Manning, P.A.

(57) ABSTRACT

A leveling assembly for an appliance door is described. The leveling assembly causes vertical movement of a decorative door panel relative to an appliance door.

17 Claims, 2 Drawing Sheets

LEVELING ASSEMBLY FOR APPLIANCE DOORS

FIELD OF THE INVENTION

The present disclosure relates to a leveling assembly for appliance doors.

BACKGROUND OF THE INVENTION

Traditional appliance doors have a factory-installed exterior cover that is made from high grade sheet steel, such as stainless steel, or from corrosion-protected sheet steel. More recently, appliances have been integrated into kitchen furniture or installed adjacent thereto and the design of such doors is often matched to the adjacent kitchen furniture.

An integrated appliance door can be constructed with an appliance panel, which performs the function of sealing the internal space of the appliance and is usually preassembled on the appliance as supplied by the manufacturer, and a decorative panel, which is subsequently joined to the appliance panel after the appliance is installed in its intended place of use. An objective during installation of such a decorative panel is to achieve flush and level alignment with the kitchen furniture adjacent thereto. With integrated appliances, the length and/or width of the decorative panel is generally a few centimeters longer and/or wider than the appliance panel since the decorative panel must cover both the appliance panel as well as the opening for the space in which the appliance is installed.

Current mechanisms for decorative panel adjustment require a great deal of time and effort. For instance, existing mechanisms typically utilize turnscrew posts to provide vertical lift to decorative panels. Such mechanisms are difficult to access, not easily operated, and fail to achieve precise decorative panel adjustment.

Accordingly, a leveling assembly that allows for more efficient decorative panel adjustment would be desirable. An appliance door incorporating such a leveling assembly would be particularly useful.

BRIEF DESCRIPTION OF THE INVENTION

Aspects and advantages of the disclosure will be set forth in part in the following description, or may be obvious from the description, or may be learned through practice of the disclosure.

In certain embodiments of the present disclosure, a leveling assembly kit for an appliance door is described. The leveling assembly kit includes an alignment element that is configured to be attached to the top portion of an appliance door. The kit further includes at least two ramp elements, each ramp element having a sloped surface. The kit still further includes a bracket element that is configured to be attached to a decorative door panel. The bracket element includes an alignment portion that is configured to interface with the alignment element and at least two leveling portions that are configured to interface with each of the two ramp elements, respectively. The ramp elements are configured to cause vertical movement of the decorative door panel relative to the appliance door and the alignment element permits vertical movement of the alignment portion and bracket element with respect to the alignment element.

In yet other embodiments of the present disclosure, a door for an appliance is described. The door includes an appliance door comprising an alignment element attached to the top portion of the appliance door. The door further includes a decorative door panel comprising a bracket element attached thereto. The bracket element includes an alignment portion that is interfaced with the alignment element and at least two leveling portions that are interfaced with each of two ramp elements, respectively. Each of the ramp elements have sloped surfaces and are configured to cause vertical movement of the decorative door panel relative to the appliance door and the alignment element permits vertical movement of the alignment portion and bracket element with respect to the alignment element.

In still other embodiments of the present disclosure, A method for leveling a decorative door panel for an appliance is described. The method includes positioning a decorative door panel on an appliance door. The appliance door comprises an alignment element attached to the top portion of the appliance door. The decorative door panel comprises a bracket element attached thereto. The bracket element includes an alignment portion that is interfaced with the alignment element and at least two leveling portions that are interfaced with each of two ramp elements, respectively. Each of the ramp elements have sloped surfaces. The method further includes moving the ramp elements to cause vertical movement of the decorative door panel relative to the appliance door and leveling of the decorative door wherein the alignment element permits vertical movement of the alignment portion and bracket element with respect to the alignment element.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure, including the best mode thereof, directed to one of ordinary skill in the art, is set forth in the specification, which makes reference to the appended figures, in which.

DETAILED DESCRIPTION OF THE INVENTION

Figure 1:
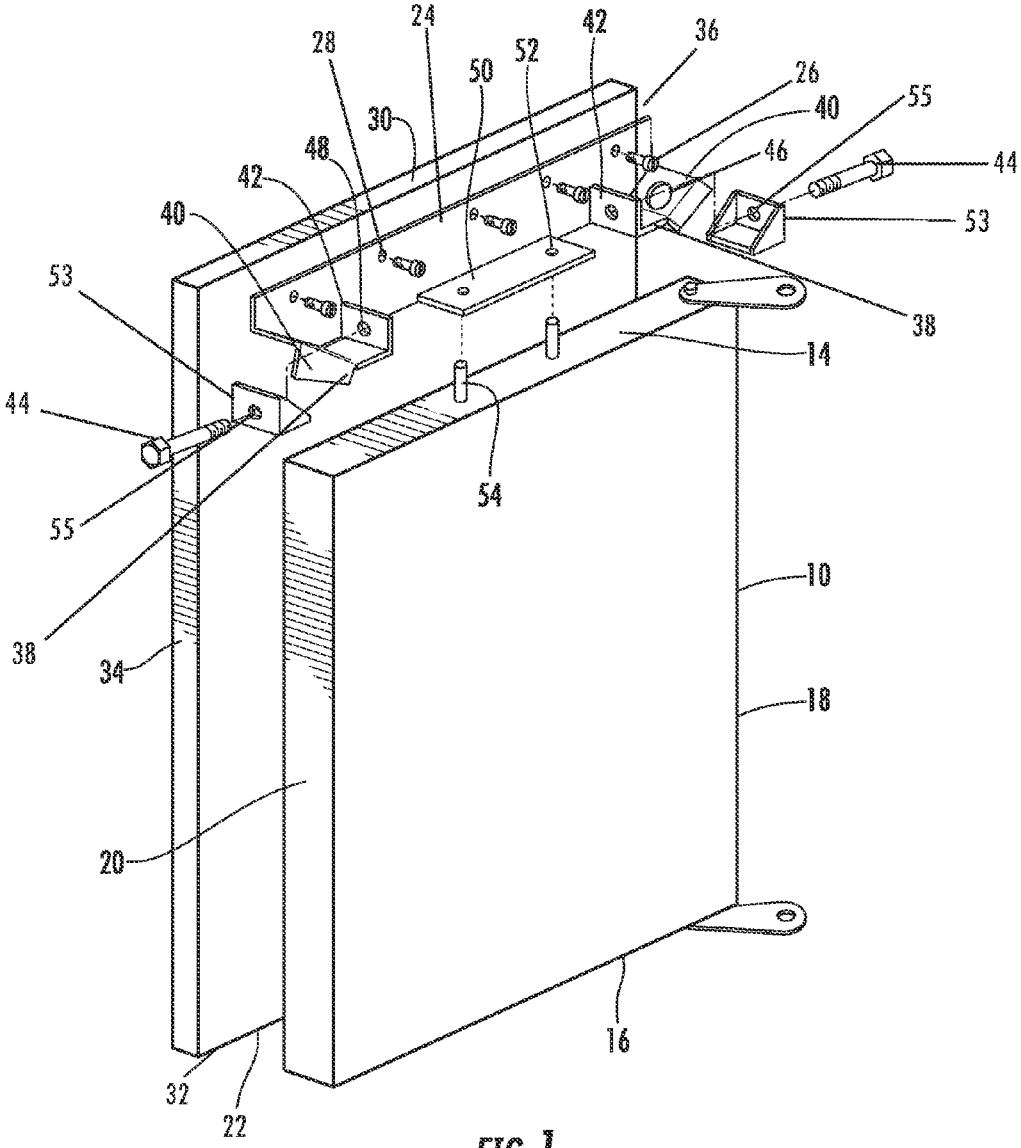
FIG. 1 provides a perspective exploded view of a leveling assembly on an appliance door in accordance with certain aspects of the present disclosure.
Figure 2:
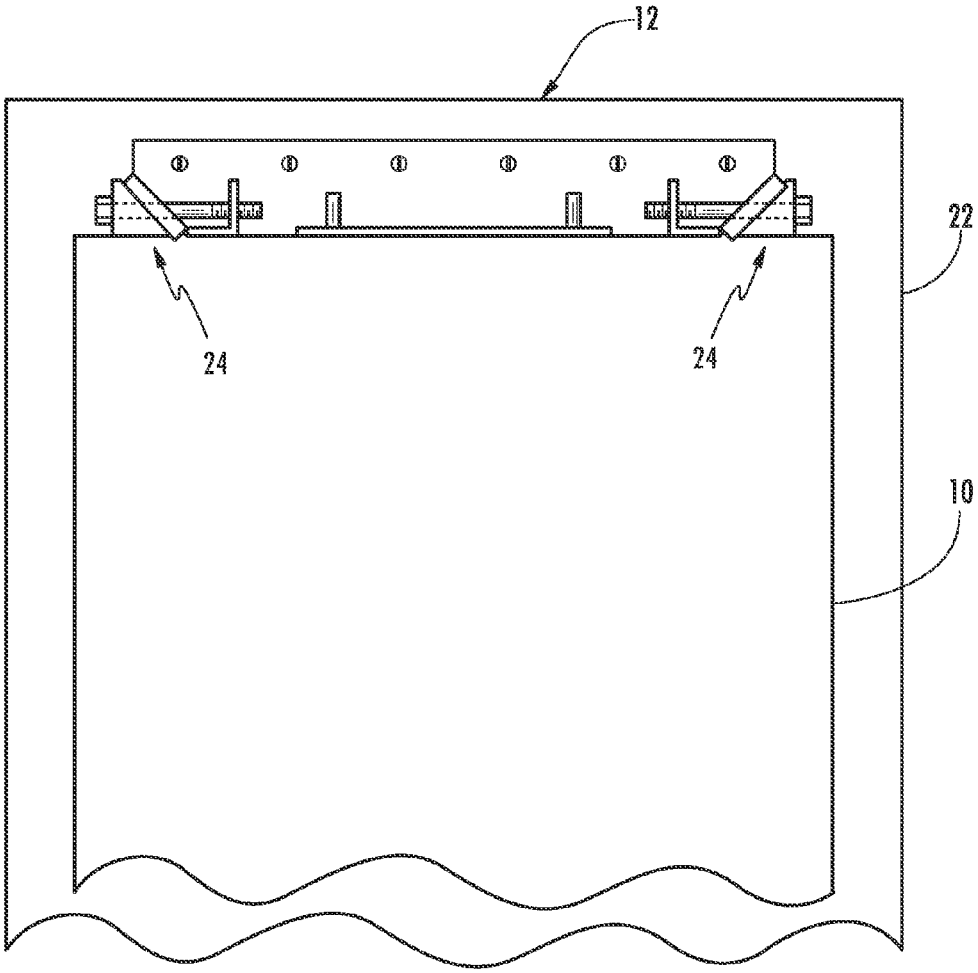
FIG. 2 provides a front view of the leveling assembly of FIG. 1.

The present disclosure relates to leveling assembly for an appliance door that can greatly simplify the process for leveling a decorative door panel on an appliance door. The leveling assembly includes a bracket that can attach to a decorative door panel and alignment posts that can attach to the top portion of an appliance door and can assist in positioning the bracket and door assembly. Leveling screws can pass through clearance slots in ramps and screw into holes that are present in the bracket which allows for quick and easy leveling by turning such screws. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, an exemplary leveling assembly is shown in connection with an appliance door suitable for use with a refrigerator (not shown). While a refrigerator door will be used to illustrate the leveling assembly of the present disclosure, it should be appreciated that the leveling assemblies described herein can be used in connection with any integrated appliance door.

FIG. 1 illustrates a perspective exploded view of a refrigerator door 10 which includes a leveling assembly 12 of the present disclosure. The conventional refrigerator door 10 can include a hollow body filled with a foamed polymer material with a durable outer skin material. The door includes a top portion 14, bottom portion 16, and side edges 18, 20. The length, width, and height of refrigerator door 10 can vary as would be understood by one of ordinary skill in the art depending on the size and model of the appliance.

A decorative door panel 22 is illustrated adjacent to the refrigerator door 10. The panel 22 can be made of any suitable material as would be understood by one of ordinary skill in the art including wood, laminate, stainless steel, or the like. As described previously, integrated appliance doors can be constructed with an appliance panel (refrigerator door 10), which performs the function of sealing the internal space of the appliance. The length and/or width of the decorative panel 22 can be of any suitable size as would be understood by one of ordinary skill in the art so that decorative panel 22 can cover both the refrigerator door 10 as well as the opening for the space in which the appliance is installed. The decorative door panel 22 will often subsequently be joined to the refrigerator door 10 after the appliance is installed in its intended place of use. The decorative door panel 22 can include a top portion 30, bottom portion 32, and side edges 34, 36.

Referring again to FIG. 1, bracket 24 is attached to decorative door panel 22 by a plurality of screws 26 which pass through openings 28 defined by bracket 24. However, bracket 24 can be attached to decorative door panel 22 (including removably attached) using any other method as would be known and understood by one of ordinary skill in the art including fasteners, adhesive, hook and loop materials, or the like.

Bracket 24 can be positioned at any suitable location on decorative door panel 22 but is typically located near the top portion 30. Bracket 24 can be of any suitable length and width. For instance, in certain embodiments bracket 24 is substantially similar in width to decorative door panel 22.

Bracket includes two or more leveling portions 38. Leveling portions 38 can be located on either side of bracket 24 and include a sloped surface 40 and a vertical portion 42 that is generally perpendicular to decorative door panel 22. Sloped surface 40 defines an opening 46 through which leveling screw 44 can pass through. Vertical portion 42 defines a threaded portion 48 to receive leveling screw 44. Each leveling portion 38 is complimentary in shape to a ramp portion 53. Two or more ramp portions 53 are present adjacent to bracket 24. Each ramp portion 53 defines an opening 55 through which leveling screw 44 can pass. In operation, ramp portion 53 slides relative to bracket 24 and refrigerator door 10 such that when a ramp portion 53 contacts a leveling portion 38, leveling portion 38 rises vertically with decorative door panel 22. Ramp portion 53 acts as a wedge against leveling portion 38.

Bracket further includes an alignment section 50 that can define one or more holes 52. Alignment section holes 52 are configured to accommodate one or more alignment elements 54. Alignment element 54 can be located at the top portion of refrigerator door 10. Alignment element 54 can be attached to refrigerator door 10 (including removably attached) using any other method as would be known and understood by one of ordinary skill in the art including fasteners, adhesive, hook and loop materials, or the like. Alignment element 54 can be of any suitable shape and or size and is present to limit movement of decorative door panel 22 in a horizontal plane but allow movement in the vertical plane so that decorative door panel 22 can be leveled. For instance, in certain embodiments, alignment element 54 can take the form of a cylindrical post and have a suitable length to allow one or both sides of decorative door panel 22 to be adjusted to an appropriate level.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A leveling assembly kit for an appliance door, comprising:

an alignment element, the alignment element eon figured to be attached to the top portion of an appliance door;

at least two ramp elements, each ramp element having a sloped surface; and a bracket element, the bracket element configured to be attached to a decorative door panel, the bracket element including an alignment portion that is configured to interface with the alignment element and at least two leveling portions that are configured to interface with each of the two ramp elements, respectively, each of the at least two leveling portions being located on opposite sides of the alignment portion, wherein the ramp elements are configured to cause vertical movement of the decorative door panel relative to the appliance door and the alignment element permits vertical movement of the alignment portion and bracket element with respect to the alignment element, wherein each ramp element defines an opening configured to permit a leveling screw to pass therethrough and wherein each leveling portion defines a threaded opening configured to receive and threadingly engage such leveling screw, wherein the at least two ramp elements are configured for sliding along the top portion of the appliance door.

2. A leveling assembly as in claim 1, wherein the alignment element comprises at least one vertical post.

3. A leveling assembly as in claim 1, wherein the alignment element comprises at least two vertical posts.

4. A leveling assembly as in claim 1, wherein each leveling portion has a sloped surface that is complimentary to the sloped surface of the ramp element for which the leveling portion is configured to interface with.

5. A leveling assembly as in claim 1, wherein each leveling portion is located at or near the ends of the bracket element.

6. A door for an appliance comprising:

an appliance door, the appliance door comprising an alignment element attached to the top portion of the appliance door; and a decorative door panel, the decorative door panel comprising a bracket element attached thereto, the bracket element including an alignment portion that is interfaced with the alignment element and at least two leveling portions that are interlaced with each of two ramp elements, respectively, each of the at least two leveling portions being located on opposite sides of the alignment portion, wherein each of the ramp elements have sloped surfaces and are configured to cause vertical movement of the decorative door panel relative to the appliance door and the alignment element permits vertical movement of the alignment portion and bracket element with respect to the alignment element, wherein each ramp element defines an opening configured to permit a leveling screw to pass therethrough and wherein each leveling portion defines a threaded opening configured to receive and threadingly engage such leveling screw, wherein the two ramp elements are configured for sliding along the top portion of the appliance door.

7. A door as in claim 6, wherein the alignment element comprises at least one vertical post.

8. A door as in claim 6, wherein the alignment element comprises at least two vertical posts.

9. A door as in claim 6, wherein each leveling portion has a sloped surface that is complimentary to the sloped surface of the ramp element for which the leveling portion is configured to interlace with.

10. A door as in claim 6, wherein each leveling portion is located at or near the ends of the bracket element.

11. A door as in claim 6, wherein the door is configured to be located on a refrigerator.

12. A method for leveling a decorative door panel for an appliance comprising:

positioning a decorative door panel on an appliance door, the appliance door comprising an alignment element attached to the top portion of the appliance door and the decorative door panel comprising a bracket element attached thereto, the bracket element including an alignment portion that is interfaced with the alignment element and at least two leveling portions that are interfaced with each of two ramp elements, respectively, each of the at least two leveling portions being located on opposite sides of the alignment portion, wherein each of the ramp elements have sloped surfaces that define openings that are respectively, configured to permit a leveling screw to pass therethrough and wherein each leveling portion defines a threaded opening configured to, receive and threadingly engage such leveling screw;

moving the ramp elements along the top portion of the appliance door in order to cause vertical movement of the decorative door panel relative to the appliance door and leveling of the decorative door wherein the alignment element permits vertical movement of the alignment portion and bracket element with respect to the alignment element.

13. A method as in claim 12, wherein the alignment element comprises at least one vertical post.

14. A method as in claim 12, wherein the alignment element comprises at least two vertical posts.

15. A method as in claim 12, wherein each leveling portion has a sloped surface that is complimentary in the sloped surface of the ramp element for which the leveling portion is configured to interface with.

16. A method as in claim 12, wherein each leveling portion is located at or near the ends of the bracket element.

17. A method as in claim 12, wherein the door is configured to be located on a refrigerator.

* * * * *